US007311873B2

(12) United States Patent
Moxson et al.

(10) Patent No.: US 7,311,873 B2
(45) Date of Patent: Dec. 25, 2007

(54) PROCESS OF DIRECT POWDER ROLLING OF BLENDED TITANIUM ALLOYS, TITANIUM MATRIX COMPOSITES, AND TITANIUM ALUMINIDES

(75) Inventors: Vladimir S. Moxson, Hudson, OH (US); Volodymyr A. Duz, Hudson, OH (US)

(73) Assignee: ADMA Products, Inc., Hudson, OH (US)

( * ) Notice: Subject to any disclaimer, the term of this patent is extended or adjusted under 35 U.S.C. 154(b) by 573 days.

(21) Appl. No.: 11/026,197

(22) Filed: Dec. 30, 2004

(65) Prior Publication Data

US 2006/0147333 A1 Jul. 6, 2006

(51) Int. Cl.
*B22F 3/18* (2006.01)

(52) U.S. Cl. ..... 419/3; 419/13; 419/14; 419/19; 419/33; 419/43

(58) Field of Classification Search ..... 419/13, 419/14, 33, 43; 418/19
See application file for complete search history.

(56) References Cited

U.S. PATENT DOCUMENTS 3,205,099 A * 9/1965 Vordahl ..... 419/63
4,108,651 A * 8/1978 Tapley ..... 419/3
4,602,954 A * 7/1986 Davies et al. ..... 75/232
4,639,281 A * 1/1987 Sastry et al. ..... 148/407
5,799,238 A * 8/1998 Fisher et al. ..... 419/7
5,903,813 A * 5/1999 Moxson et al. ..... 419/28
2004/0096350 A1* 5/2004 Moxson et al. ..... 419/38
2004/0146736 A1* 7/2004 Ivanov et al. ..... 428/609

* cited by examiner

*Primary Examiner*—Roy King
*Assistant Examiner*—Ngoclan T. Mai

(57) ABSTRACT

The invention relates to manufacturing of fully dense strips, plates, sheets, and foils from titanium alloys, titanium metal matrix composites, titanium aluminides, and flat multilayer composites of said materials by direct powder rolling of blended powders followed by sintering. The resulting titanium alloy flat products have properties that meet or exceed the conventional ingot metallurgy alloys and are suitable for aerospace, automotive, sporting goods, and other applications. The process includes: (a) providing C.P. titanium matrix powder and at least one powder of alloying components, (b) mechanical activation by attrition of all alloying components, (c) blending titanium powder with attrited alloying powders obtained in step (b), (d) cold direct powder rolling in a mill with horizontally-positioned rolls with different diameters to achieve density of the rolled strip of 60±20% of the theoretical value with subsequent densification by re-rolling green strip, (e) densification by cold re-rolling of the green strip, (f) multiple cold re-rolling, and (g) sintering.

9 Claims, No Drawings

PROCESS OF DIRECT POWDER ROLLING OF BLENDED TITANIUM ALLOYS, TITANIUM MATRIX COMPOSITES, AND TITANIUM ALUMINIDES

FIELD OF THE INVENTION

The present invention relates to fully dense strips, plates, sheets, and foils of titanium alloys, titanium metal matrix composites, titanium aluminides, and multilayer products of said materials manufactured by direct rolling and sintering of blended powders.

BACKGROUND OF THE INVENTION

Fully dense flat products of titanium alloys, titanium metal matrix composites, and titanium aluminides are of particularly great interest in the aerospace, automotive, sporting goods, and other industries due to their excellent strength-to-density ratio, stiffness, strength and fatigue related properties, and high temperature and corrosion resistance. But the manufacturing of titanium-based strips, plates, sheets, or foils is characterized by high production costs of multiple rolling/annealing operations that are caused by relatively high hardness and low ductility of titanium alloys, especially, titanium matrix composites and titanium aluminides. Multiple rolling/annealing cycles create textured materials whose mechanical properties are not uniform in transvers and longitudinal directions. Besides expensive processing of titanium alloys, it is very difficult to manufacture the reinforced titanium-based materials, as well as composite multilayer structures using the conventional technologies. In some applications, it is desirable to increase stiffness of the titanium alloys by reinforcing them with various hard particles. The reinforcing components should be thoroughly and uniformly dispersed in the volume of the matrix alloy to achieve the maximum mechanical properties of the composite strips. It is extremely difficult to manufacture such high-performing composite flat products by conventional wrought metallurgy. Another application requires production of the titanium composite structures having high fracture toughness core layer with high-temperature capability of external layers, such as a TiAl/Ti6Al-4V/TiAl composite. Manufacture of these composite structures is also very expensive by the conventional wrought metallurgy techniques.

The direct powder rolling process, among other competitive methods, has the potential of becoming a cost-effective method of manufacturing strip products from a variety of powder metallurgy alloys, multilayer structures, and composite materials. It is possible to produce titanium alloy strips by an economically attractive process using direct powder rolling at room temperature in air and subsequent sintering in a protective atmosphere.

Direct powder rolling of blended elemental titanium alloys promises a solution of both economical and quality problems that can provide the near full density flat product material produced by this cost effective manufacturing process.

Despite more than fifty years of experience in industrial applications for making different metals and alloys, conventional direct powder rolling processes had not been used in the manufacture of titanium flat products. For example, methods for manufacturing strips from blended elemental powders disclosed in the U.S. Pat Nos. 4,602,954 and 4,617,054 cannot provide 100% density strips due to a presence of residues of organic binders that do not allow to achieve an effective densification by compaction during cold rolling of green strip, moreover, evaporation of binders creates the voids which cannot be healed during sintering and which form so-called gaseous porosity.

Another sources of porosity in sintered strips are the diffusion voids resulted from the mutual diffusion interaction between the titanium base particles and the particles of alloying elements at the sintering temperature. The larger the particles of alloying elements, the bigger the voids developed during sintering. No one of the methods known from the prior art can avoid this type of porosity in final products.

Conventional technology of direct powder rolling of blended titanium alloys always is characterized by both types of porosity, gaseous and diffusion. Increasing the compression forces during the rolling of green strips results in cracking of the rolled metal due to difference in mechanical properties of alloying elements in the blends. Therefore, such methods as described in the U.S. Pat. No. 4,108,651 which are effective for some metal powders are not effective for direct powder rolling the blended elemental titanium alloys.

Thus, all prior art methods of fabricating dense strip products from various metal powders by direct powder rolling and sintering have considerable problems if titanium alloy powders are being used. Technological drawbacks associated with low ductility and diffusion and gaseous porosities make the direct powder rolling process unacceptable when strips, plated, and foils are being rolled from titanium alloy powders because the finished flat products are not fully dense and insufficient mechanical properties make these products unacceptable for industrial applications. Therefore, the low-cost direct powder rolling process is not currently being used in the titanium industry.

The process of this invention offers the advantages over the conventional powder metallurgy techniques. Furthermore, the method overcomes the above mentioned limitations associated with the prior art which prevented the achievements of fully dense titanium alloy strips, plates, sheets, and foils manufactured by direct rolling of blended elemental powders.

OBJECTS OF THE INVENTION

It is an object of this invention to produce fully-dense, essentially uniform structure of strip, plate, sheet, or foil and other flat products from titanium alloys, titanium matrix composites, titanium aluminides, and multilayer composites by direct powder rolling followed by sintering operation.

Another object of the invention is to establish a continuous cost-effective process of direct rolling of titanium alloy powders prepared ether from blended elemental powders or from a combination of pre-alloyed hard powders and relatively ductile base titanium powders.

It is another object of the invention to produce fully-dense strip products from titanium alloy powders with acceptable mechanical properties uniform in transverse and longitudinal directions without a need for further hot deformation.

A further object of the present invention is to provide a powder metallurgy technique for manufacturing strips, plates, sheets, or foils of titanium alloys that can be used as final product in the as-sintered state, without finishing by machining or chemical milling.

And, yet, another objective is to produce the composite multilayer flat structures from various combinations of layers of the above listed titanium alloys and titanium aluminides.

SUMMARY OF THE INVENTION

While the use of a number of technologies for direct powder rolling and sintering of the various metal powders has previously been contemplated in the powder metallurgy, as mentioned above, problems related to the achievement of near full density structures (over 99% of the theoretical value), process stability, controlled finished sizes with close tolerances, residual porosity, insufficient mechanical properties, and high manufacturing cost have not been solved in manufacturing of the flat products from titanium and titanium alloy powders. This invention overcomes shortcomings in the prior art.

The aims of the invention are (a) a manufacture of near fully-dense (over 99% of the theoretical density) flat products of titanium alloys by direct powder rolling followed by re-rolling the green strip and sintering, and (b) a low cost production process of near fully-dense titanium alloy strip products with improved mechanical properties.

The major focus was placed on the technical aspects of low-cost manufacturing the titanium flat products by direct powder rolling process followed by re-rolling/densification of the green strip, and then, sintering operation which would yield the near-full density materials. To this end, we have developed an affordable process utilizing optimal combination of "soft" and hard particles in the elemental powder blend and multi-step cold rolling in horizontal and vertical roll units that are characterized by different roll diameters and rotation rates. Our process realizes a cost-effective manufacturing approach that has made it possible for a further transition to a production scale process.

Low production costs of our newly developed process was achieved by using a single cold powder rolling step in air at room temperature. This process does not comprises any hot rolling steps in protective atmospheres or an expensive pack-roll process currently being used in production of thin gage titanium alloy flat products. Improvements in direct powder cold rolling operations allowed (i) to improve ductility of the green strip, (ii) to provide additional densification of the strip by bending deformation during rolling, (iii) to increase compressive stresses during further densification of the green strip without cracking, and (iiii) to avoid diffusion porosity during sintering, that all together resulted in the final products with the density close to theoretical density (over 99% of the theoretical value). This level of density of powdered titanium alloy flat products was not achieved in the prior art.

The invented process is suitable for the manufacture of strips, plates, sheets, and foils of titanium alloys, titanium matrix composites, and titanium aluminides, and the composite layered structures from these alloys having improved mechanical properties such as lightweight plates and sheets for aircraft and automotive applications, armor plates for the military vehicles, honeycomb structures, heat-sinking lightweight electronic substrates, bulletproof structures for vests, partition walls and doors, and other applications.

The above mentioned and subsequent objects, features, and advantages of our invented technology will be clarified by the following detailed description of preferred embodiments of the invention.

DETAILED DESCRIPTION AND PREFERRED EMBODIMENTS OF THE INVENTION

As discussed, the present invention relates to the novel process of manufacturing near fully-dense titanium flat products by direct powder rolling of the blend produced from a mixture of titanium and alloying elemental powders or the mixture of elemental and pre-alloyed powders with titanium powder followed by sintering of the cold re-rolled and densified green strip.

The preliminary mechanical reduction of particle sizes by attrition of all alloying components to be added to commercially pure (C.P.) titanium powder plays an unique role in this process which results in the formation of highly-dense but ductile structure of the green strip during direct powder rolling and subsequent cold re-rolling.

The particle size distribution in the initial blend formed from soft C.P. titanium base powder and particles of alloying components is characterized by the fact that the particle size of attrited alloying powders is at least ten times smaller than the particle size of the matrix C.P. titanium powder. This optimal particle size distribution resulted in (a) formation of ductile structure of the green strip due to a volume predominance of the "soft" titanium base particles, and (b) prevention or minimizing a diffusion porosity during sintering operation.

Together with the below described improvements of direct powder rolling process, the particle size optimization and attrition of alloying particles allowed to obtain a final strip product having the density close to 100% of the theoretical value. No previously known methods, mentioned in the References, allow producing such a dense titanium flat products by direct powder rolling followed by sintering operation.

In practice, the articles of the invention are produced from at least two types of powdered metal particles, specifically "soft" titanium base particles and hard alloy forming particles that are represented by (a) master alloy powder and elemental powders producing the final chemistry of resulting titanium alloy, (b) reinforcing compounds such as carbides, nitrides, borides, and/or oxides that improve mechanical properties of resulting rolled strip, and (c) particles of pure metals and/or materials that form chemical compounds with titanium and/or master alloys during mechanical alloying followed by blending and sintering such as carbon black, graphite, silicon, chromium, and the like. Particles mentioned in the (a) and (c) groups should be attrited before blending with the matrix titanium powder.

Hard particles reinforcing the final titanium matrix composite strip are selected (but not limited) from the group consisting of SiC, TiC, WC, TaC, $B_4C$, BN, TiN, AlN, $Si_3N_4$, colloidal silica, alumina, and/or titanium oxide and these reinforcing particles may be used as a solely reinforcement elements or added together with mechanically alloyed reinforcement in any designed proportion to the final titanium alloy composition by blending.

The preferred master alloy particles are produced from an alloy of aluminum and vanadium. The weight ratio of aluminum to vanadium is not critical but the excellent result has been obtained by using ten (10) weight percent of the alloy containing 60 wt. % of aluminum and 40 wt. % of vanadium to 90 weight percent of C.P. Titanium powder to manufacture of the strip of Ti-6Al-4V alloy.

In another embodiment, a carbide-reinforced titanium composite strip based on the Ti-6Al-4V alloy matrix was manufactured by preparing an initial powder blend containing 79.3 wt. % of pure titanium powder having a particle size of 80 mesh (180-250 μm), 8.2 wt. % of attrited 60% Al-40% V master alloy, 5 wt. % of graphite mechanically alloyed with 1.5 wt. % of Cr and 3.5 wt. % of C.P. Titanium powder and 2.5 wt. % of dispersing TiC particles (having 150-200 μm particle size). All attrited powders have a particle size of <10 μm while the average sizes of C.P. Titanium powder and TiC particles were at least ten times larger than 10 microns.

In order to obtain the benefits of the present invention, it is essential that cold direct powder rolling of the blended titanium alloy is carried out in a mill with horizontally-positioned rolls to achieve density of the rolled strip of 60±20% of the theoretical value, whereby diameters of rolls are different, so that the green strip is bent for the subsequent densification by a second horizontal rolling mill staying in line with the first rolling mill. The diameter of the rolls for direct powder rolling mill is 40-250 times larger than thickness of the rolled strip. Speed of rotation for a set of couple rolls of each mill should be 5-15% different for at least one of the mills—direct powder rolling mill or re-rolling mill, so that additional densification would take place as a result of shearing effect.

The relatively low density 60±20% of the green strip provides necessary ductility of the strip after the first cold rolling step. This is one of key points of the invention. Sufficient ductility allows an effective densification of the green strip by increased compression in the second cold re-rolling step and subsequent re-rolling steps may be applied to achieve over 99% of the theoretical density for green strip. Stress relief heat treatment may be applied if required. The green strip may be coiled prior to re-rolling or sintering, if required.

Densification of the directly-rolled low-dense but ductile green strip is carried out by cold re-rolling of in a horizontal rolling mill. Diameter of the rolls of the densification mill is 1.1-5 times larger than the diameter of rolls of the direct powder rolling mill which allows to provide the increased compression forces and avoid a shearing action of the green strip. Density of the rolled green strip after this cold rolling step is in the range of 90±10% of the theoretical density.

The subsequent multiple cold re-rolling of the green strip in vertically-positioned rolls at equal rotation rate of the edging rolls results in density of the green rolled strip about 100% of the theoretical value, and only after that, the green strip is directed to sintering operation in a protective atmosphere or in vacuum to finalize the production cycle. Sintering may be carried out in a batch or in a continuous belt furnace to increase productivity of titanium alloy strips, plates, sheets, or foils.

The employed sintering temperature will vary depending on the specific composition which makes up the final titanium alloy strip, with the only requirement—to avoid liquid phase that can occur during the sintering procedure. For example, the sintering temperature of the Ti-6Al-4V alloy powdered strip should be in the range of 2200-2350° F., while the sintering temperature of the titanium matrix composite TiC/Ti-6Al-4V may be performed in the range of 2100-2300° F. Typical mechanical properties of fully-dense Ti-6Al-4V alloy strips manufactured by the process of the present invention are:

Ultimate tensile strength in transverse and longitudinal directions is 130-140 ksi (897-966 MPa), Yield strength in transverse and longitudinal directions is 120-130 ksi (828-897 MPa), Elongation is over 10%.

Typical mechanical properties of fully-dense TiC/Ti-6Al-4V alloy strips manufactured by the process of the present invention are:

Ultimate tensile strength is 161-173 ksi (1110-1193 MPa),

Yield strength is 129-146 ksi (890-1007 MPa),

Elongation is 3.2-3.9%.

EXAMPLE 1

The plate of 6" by 6" by 0.1" of the alloy Ti-6Al-4V was manufactured from elemental blended powders in accordance with the present invention.

10 wt. % of a nominal 60% Al-40% V alloy powder was attrited for 24 h with 0.25" diameter steel balls to obtain a particle size <10 μm. The attrited powder of alloying component was blended for 0.5 hour with 90 wt. % of C.P. titanium powder having a particle size of less than 100 mesh (less than 149 μm). This blend was fed through a single hopper to the nip of a mill with horizontally-positioned two rolls for cold direct powder rolling. Diameter of rolls was in the range of 50-55", whereby one roll had diameter of 55" while another one had diameter of 50" that resulted in bending deformation of the green strip. A relatively ductile green strip about 0.25" thick with density about 70% was manufactured at the rolling rate of 8 ft/min. The bent green strip was directed to the subsequent densification in a second horizontal rolling mill staying in line with the first rolling mill. This mill had diameters of both rolls 65" but rotations of edging rolls were different in the rate by 5% to promote densification of the green strip by shear deformation. The green strip obtained from this rolling step had 0.15" thickness and density about 89% from the theoretical value. The strip was annealed for 2 h in vacuum at 752° F. (400° C.) for stress relief. Then, the green strip was subjected to cold re-rolling in the horizontal mill at the rolling rate 10 ft/min. Diameters of both rolls were 75" that allowed higher compressive stresses applied to the rolled metal than that during previous powder rolling operations. The green strip having density of 99.7% was manufactured after multiple cold re-rolling in this rolling mill at continuously reduced gap between the roll until 0.100" thickness was achieved. Then, the green strip was subjected to sintering in vacuum for 4 h at 2200° F. The resulting flat product of Ti-6Al-4V alloy had density about 100% of the theoretical value with a uniform structure that was characterized by almost equal mechanical properties both in the transverse and longitudinal directions.

EXAMPLE 2

The plate of 6" by 6" by 0.1" of the TiC/Ti-6Al-4V composite material was manufactured from elemental and reinforcing blended powders in accordance with the present invention.

The carbide-reinforced titanium composite strip based on the Ti-6Al-4V alloy matrix was manufactured by preparing an initial powder blend containing 79.3 wt. % of C.P. titanium powder having a particle size of 80 mesh (180-250 μm), 8.2 wt. % of attrited 60% Al-40% V master alloy, 5 wt. % of graphite mechanically alloyed with 1.5 wt. % of Cr and 3.5 wt. % of C.P. Titanium powder and 2.5 wt. % of dispersing TiC particles (having 150-200 μm particle size). All attrited powders have a particle size of <10 μm while the average sizes of C.P. Titanium powder and TiC particles were at least ten times larger than 10 microns. Technological parameters and sequence of direct powder rolling, cold re-roling, and relief heat treatment was the same as in Example 1. The resulting green strip had density of 99.4%.

Sintering was carried out in vacuum for 4 h at 2100° F. The resulting plate of TiC/Ti-6Al-4V composite material had density about 99.8% of the theoretical value with a uniform structure that was characterized by almost equal mechanical properties both in the transverse and longitudinal directions.

We claim:

1. Process of direct powder rolling of blended elemental titanium alloys, titanium matrix composites, and titanium aluminides for manufacturing strips, plates, sheets, foils, and other flat products comprises the following steps:

(a) providing a commercially pure (C.P.) titanium matrix powder and at least one powder of alloying components comprising elemental alloying powder or powders, pre-alloyed master alloy powders, and hard reinforcing particles being used to achieve the required chemical composition and/or reinforcement of the final product, (b) mechanically activating and reducing by attrition of all alloying components, whereby the particle size of attrited alloying powders is at least ten times smaller than the particle size of the matrix titanium powder, (c) blending titanium powder as a ductile matrix material with attrited alloying powders obtained in step (b) at the ratio of blended powders that provides the required chemical composition of the final product, (d) cold direct powder rolling of the blend in a mill with horizontally-positioned rolls to achieve density of the rolled strip of 60±20% of the theoretical value, whereby diameters of rolls are different, so that the green strip is bent for the subsequent densification by a second horizontal rolling mill staying in line with the first rolling mill, and rotations of edging rolls of at least one of said mills differ in the rate by 5-15% to promote densification of the green strip by shear deformation, the diameter of the rolls is 40-250 times larger than thickness of the rolled strip, (e) densifying by cold re-rolling of the green strip in a horizontal rolling mill, whereby diameter of the rolls of the densification mill is 1.1-5 times larger than the diameter of rolls of the direct powder rolling mill to provide compressive action and avoid shearing action of the green strip and achieve density of the rolled strip in the range of 90±10% of the theoretical value, (f) multiple cold re-rolling of the strip in vertically-positioned rolls at equal rotation rate of the edging rolls to achieve density of the green rolled strip about 100% of the theoretical value, and (g) sintering of near fully-dense green rolled strip in vacuum, in protective atmosphere batch furnace, or in continuous belt furnace in protective atmosphere.

2. Process for direct powder rolling of blended titanium alloys, titanium matrix composites, and titanium aluminides according to claim 1, wherein hard reinforcing particles are represented by at least one group of (i) elemental reinforcement by mechanical alloying of any alloying elements, (ii) dispersing particles of metal carbides, nitrides, oxides or mixture thereof, and (iii) a mixture of mechanically-alloyed fine elemental particles with coarse carbide, nitride, oxides particles or mixture thereof.

3. Process for direct powder rolling of blended titanium alloys, titanium matrix composites, and titanium aluminides according to claim 1, wherein stress relief heat treatment of matrix titanium is carried out after at least one rolling and re-rolling step and the heat treatment temperature should not exceed the temperature causing over ten (10) volume percent diffusion of alloying elements in the green strip to maintain a soft titanium matrix for subsequent densification of the green strip during cold re-rolling.

4. Process for direct powder rolling of blended titanium alloys, titanium matrix composites, and titanium aluminides according to claim 1, wherein the initial powder blend is added with:

(a) attrited particles of at least one master alloy that are able to form the specific composition of resulting titanium alloy during sintering and heat treatment of the green rolled strip, (b) particles of at least one hard reinforcing compound selected from carbides, nitrides, borides, and oxides that improve mechanical properties of resulting rolled strip after sintering and heat treatment, and particle size distribution is selected in such a way that optimizes structure and properties of the final alloy, (c) particles of pure metals and/or materials that form chemical compounds with titanium and/or master alloys during mechanical alloying, sintering and heat treatment of the rolled strip.

5. Process for direct powder rolling of blended titanium alloys, titanium matrix composites, and titanium aluminides according to claim 3, wherein the master alloy is attrited aluminum-vanadium alloy powder with the particle size that is at least ten times smaller than that of titanium matrix powder.

6. Process for direct powder rolling of blended titanium alloys, titanium matrix composites, and titanium aluminides according to claim 3, wherein hard reinforcing particles are selected from the group consisting of SiC, TiC, WC, TaC, $B_4C$, BN, TiN, AlN, $Si_3N_4$, colloidal silica, alumina, and titania.

7. Process for direct powder rolling of blended titanium alloys, titanium matrix composites, and titanium aluminides according to claim 3, wherein particles forming chemical compounds with titanium are selected from the group consisting of graphite, carbon black, chromium, aluminum, and silicon which are co-attritted/mechanically alloyed in any combinations.

8. Process for direct powder rolling of blended titanium alloys, titanium matrix composites, and titanium aluminides according to claim 1, wherein at least two powder blends of different compositions are simultaneously supplied in the mill for direct powder rolling to manufacture the composite multilayer flat product.

9. Process for direct powder rolling of blended titanium alloys, titanium matrix composites, and titanium aluminides according to claim 8, wherein the composite multilayer flat product consists of a core titanium alloy between surface layers of titanium aluminide alloy to form the TiAl/Ti-6Al-4V/TiAl composite flat product.

* * * * *